US012723394B2

(12) United States Patent
Ciepluch et al.

(10) Patent No.: US 12,723,394 B2
(45) Date of Patent: Sep. 1, 2026

(54) LIGATURE MITIGATION DRAIN

(71) Applicant: Vendura Industries, LLC, Franklin, WI (US)

(72) Inventors: Mark Ciepluch, Muskego, WI (US); Michelle Kartman, Middleton, WI (US); Lucas Boesel, Muskego, WI (US)

( * ) Notice: Subject to any disclaimer, the term of this patent is extended or adjusted under 35 U.S.C. 154(b) by 111 days.

(21) Appl. No.: 19/017,541

(22) Filed: Jan. 11, 2025

(65) Prior Publication Data

US 2025/0146267 A1 May 8, 2025

Related U.S. Application Data

(62) Division of application No. 17/896,050, filed on Aug. 25, 2022, now Pat. No. 12,227,932.

(51) Int. Cl.
*E03F 5/06* (2006.01)
*E03F 5/04* (2006.01)

(52) U.S. Cl.
CPC ..... *E03F 5/06* (2013.01); *E03F 5/0407* (2013.01)

(58) Field of Classification Search
None
See application file for complete search history.

(56) References Cited

U.S. PATENT DOCUMENTS 989,405 A * 4/1911 Payne ..... A47J 47/20 4/290
1,669,586 A * 5/1928 Boosey ..... E03F 5/0407 137/577
1,792,345 A * 2/1931 Williams ..... E03F 5/0407 285/391
1,809,413 A * 6/1931 Hirshstein ..... E04D 13/0409 285/200
1,830,065 A * 11/1931 Luff ..... E04D 13/0409 285/200
2,119,923 A * 6/1938 McIntyre ..... E03F 5/08 210/247
2,783,852 A * 3/1957 Sisk ..... E03F 5/0409 210/462
2,889,928 A * 6/1959 Sisk ..... E03F 5/0407 210/163
3,212,416 A * 10/1965 Boersma ..... E03F 5/06 210/163
3,406,829 A * 10/1968 Vande Bosche ..... E03F 5/0407 210/164
3,420,552 A * 1/1969 Mork ..... E03F 5/0408 4/288
4,067,072 A * 1/1978 Izzi ..... E03F 5/0407 285/12
4,092,745 A * 6/1978 Oropallo ..... E03F 5/0408 4/292
4,146,939 A * 4/1979 Izzi ..... E03C 1/26 4/286
D253,146 S * 10/1979 Adam ..... D23/261
(Continued)

*Primary Examiner* — Robert J Popovics

(57) ABSTRACT

A ligature mitigation drain apparatus and method is disclosed which comprises an outer ring, an inner ring, and a termination ring. The outer ring surrounds the inner ring, and the inner ring surrounds the termination ring. The outer ring further comprises at least two extensions extending toward and touching the inside ring and the inner ring further comprises at least two extensions extending toward and touching the termination ring.

3 Claims, 8 Drawing Sheets

(56) References Cited

U.S. PATENT DOCUMENTS 4,233,697 A * 11/1980 Cornwall ..... E03D 11/16 4/293
4,257,892 A * 3/1981 Boersma ..... E03F 5/0407 210/163
4,261,824 A * 4/1981 Cuschera ..... E03F 5/06 210/164
4,321,713 A * 3/1982 Thompson ..... E04D 13/0409 4/290
RE31,561 E * 4/1984 Thompson ..... E04D 13/0409 4/290
4,463,461 A * 8/1984 van den Broeke ... E03F 5/0407 4/293
4,594,739 A * 6/1986 Watts ..... E03C 1/26 137/844
4,694,513 A * 9/1987 Kiziah ..... E03F 5/0408 285/136.1
4,883,590 A * 11/1989 Papp ..... E03F 5/0407 210/232
5,268,096 A * 12/1993 Robol ..... E04H 4/1236 210/167.16
5,878,448 A * 3/1999 Molter ..... E03F 5/0408 4/288
D461,233 S * 8/2002 Whalen ..... D23/261
6,442,774 B2 * 9/2002 Wilson ..... E04H 4/1236 4/292
D485,469 S * 1/2004 Siegel ..... D7/408
6,766,545 B2 * 7/2004 Hodges ..... E03C 1/20 4/679
6,810,537 B1 * 11/2004 Barnes ..... E04H 4/1236 4/507
6,817,043 B2 * 11/2004 Zars ..... E04H 4/1236 4/292
6,895,838 B2 * 5/2005 Stahnke ..... B25B 13/48 81/176.1
D562,995 S * 2/2008 Diamond ..... D25/155
D564,636 S * 3/2008 Hanna ..... D23/261
D574,066 S * 7/2008 Hanna ..... D23/216
7,600,644 B2 * 10/2009 McCallum ..... E03F 5/0404 210/450
7,632,401 B2 * 12/2009 Edelmayer ..... E03F 5/0407 52/302.6
7,658,043 B2 * 2/2010 Wroblewski ..... E03F 5/06 52/302.1
7,699,981 B2 * 4/2010 Ledford ..... E02D 29/14 52/302.1
7,964,095 B1 * 6/2011 Graybeal ..... E03F 5/04 52/302.1
7,992,236 B2 * 8/2011 Degooyer ..... E03F 5/0408 4/652
8,043,497 B2 * 10/2011 Silverstein ..... E03F 5/06 210/232
8,196,229 B1 * 6/2012 Hickok ..... E03F 5/041 4/288
D670,794 S * 11/2012 Antoniello ..... D23/262
8,347,424 B2 * 1/2013 Wroblewski ..... E04G 23/02 52/302.1
8,557,108 B2 * 10/2013 Rennels ..... E03C 1/264 210/163
8,713,724 B1 * 5/2014 Goettl ..... E04H 4/1236 4/507
8,726,926 B2 * 5/2014 Klein ..... F16K 43/00 137/315.15
8,881,490 B2 * 11/2014 Wroblewski ..... E03F 5/0407 52/302.1
8,894,850 B2 * 11/2014 Coscarella ..... E03F 5/06 210/232
D722,139 S * 2/2015 Bernoti ..... D23/260
D723,139 S * 2/2015 Bernoti ..... D23/260
9,139,996 B2 * 9/2015 Cohen ..... E03F 5/06
9,175,797 B1 * 11/2015 Behoteguy ..... E03F 5/0404
D746,955 S * 1/2016 Corder ..... D23/261
D754,829 S * 4/2016 Krombein ..... D23/261
9,322,157 B1 * 4/2016 Ismert ..... F16L 37/248
9,366,017 B2 * 6/2016 Cook ..... E03F 5/0408
9,422,707 B2 * 8/2016 Hull ..... E03F 5/0404
9,422,708 B2 * 8/2016 Hull ..... E03F 5/0409
9,422,709 B2 * 8/2016 Wroblewski ..... E03F 5/06
D779,045 S * 2/2017 Johansen ..... D23/261
D787,023 S * 5/2017 Ball ..... E03C 1/26 D23/259
9,657,469 B2 * 5/2017 Edmonds ..... E03C 1/2306
9,869,081 B1 * 1/2018 Pardo, Jr. ..... F16L 55/1157
9,994,465 B2 * 6/2018 Epstein ..... E03F 5/041
10,024,039 B2 * 7/2018 Cheng ..... E03C 1/264
10,060,109 B2 * 8/2018 Edmonds ..... E03C 1/2306
10,167,622 B2 * 1/2019 Brooks ..... E03F 5/06
10,184,238 B2 * 1/2019 Hull ..... E03F 5/0409
D843,551 S * 3/2019 Pople ..... D23/261
10,415,227 B2 * 9/2019 Rodrigues ..... F16K 15/148
10,487,492 B2 * 11/2019 Boersma ..... E03C 1/26
D874,617 S * 2/2020 Chen ..... D23/261
10,604,926 B2 * 3/2020 Beutler ..... B63B 13/00
10,676,911 B2 * 6/2020 Erlebach ..... E03F 5/0407
10,683,654 B2 * 6/2020 Priester ..... E03F 5/0407
10,722,079 B2 * 7/2020 Schuster ..... A47K 1/14
D892,276 S * 8/2020 Meyers ..... D23/261
D893,682 S * 8/2020 McDanal ..... D23/397
D897,503 S * 9/2020 Hodge ..... D23/261
10,758,093 B2 * 9/2020 Ruiz Perez ..... E03F 5/0408
10,760,250 B2 * 9/2020 Ewers ..... E03C 1/264
11,047,126 B1 * 6/2021 Whiteside ..... E03F 5/06
11,078,658 B2 * 8/2021 Say ..... E03F 3/04
D931,990 S * 9/2021 Willburn ..... D23/261
11,155,985 B2 * 10/2021 Ritger ..... E03C 1/22
11,261,594 B2 * 3/2022 Boeltl ..... E03F 5/0408
11,359,362 B2 * 6/2022 Boeltl ..... E03F 5/0407
11,391,026 B2 * 7/2022 Glazar ..... E03C 1/262
11,555,279 B2 * 1/2023 Cuellar ..... E01F 5/00
11,591,787 B2 * 2/2023 Say ..... E03F 5/0407
D1,003,407 S * 10/2023 Ciepluch ..... D23/261
D1,006,199 S * 11/2023 Ciepluch ..... D23/261
11,828,055 B2 * 11/2023 Say ..... E03F 5/0407
D1,018,792 S * 3/2024 Chen ..... D23/261
D1,024,284 S * 4/2024 Xiao ..... D23/261
11,946,241 B2 * 4/2024 Lorkowski ..... E03F 5/0409
11,982,097 B2 * 5/2024 Powers, II ..... E03F 5/04
D1,055,721 S * 12/2024 Gorski ..... D10/64
D1,055,722 S * 12/2024 Gorski ..... D10/64
D1,055,723 S * 12/2024 Gorski ..... D10/64
12,227,932 B2 * 2/2025 Ciepluch ..... E03F 5/041
12,366,063 B2 * 7/2025 Say ..... E04G 15/061
12,371,892 B2 * 7/2025 Zhang ..... E03F 5/0407
12,448,768 B2 * 10/2025 Ritger ..... E03C 1/26
12,460,402 B2 * 11/2025 Young ..... E03F 5/041
12,650,010 B2 * 6/2026 Say ..... E03F 5/0407
2003/0159211 A1 * 8/2003 Hodges ..... E03C 1/20 4/679
2004/0181868 A1 * 9/2004 Witte ..... E04H 4/1236 4/507
2004/0200162 A1 * 10/2004 Wroblewski ..... E03F 5/06 52/302.1
2005/0138722 A1 * 6/2005 Humber ..... E03D 11/16 4/252.1
2006/0219619 A1 * 10/2006 St-Cyr ..... E03F 5/06 210/232
2006/0283792 A1 * 12/2006 McCallum ..... E03F 1/00 210/163
2007/0034577 A1 * 2/2007 Bayard ..... E03F 5/06 210/163
2007/0177942 A1 * 8/2007 Meyers ..... E03F 3/046 405/40
2008/0271232 A1 * 11/2008 Self ..... E03C 1/264 29/896.62
2008/0290012 A1 * 11/2008 Shih ..... E03F 5/0407 210/163
2009/0223884 A1 * 9/2009 Wroblewski ..... E03F 5/0407 210/163
2010/0011494 A1 * 1/2010 Dees ..... E03C 1/264 4/292

(56) References Cited

U.S. PATENT DOCUMENTS

2010/0235982 A1* 9/2010 Stimpson ..... E03F 5/0408 52/302.1
2010/0320130 A1* 12/2010 Meyers ..... E03F 5/04 210/164
2012/0025517 A1* 2/2012 Majocka ..... E03F 5/041 285/27
2012/0199216 A1* 8/2012 Schramer ..... E03F 5/0407 137/362
2013/0186036 A1* 7/2013 Wroblewski ..... E04G 23/02 52/745.05
2013/0193042 A1* 8/2013 Hull ..... E03F 5/0409 210/164
2014/0116527 A1* 5/2014 Wroblewski ..... E03F 5/0407 137/15.01
2014/0130902 A1* 5/2014 Lucas ..... E03F 5/0407 29/428
2014/0138297 A1* 5/2014 Hull ..... E03F 5/0407 210/164
2014/0157514 A1* 6/2014 Cook ..... E03F 5/0408 4/679
2014/0166560 A1* 6/2014 Cohen ..... E03F 5/06 210/164
2015/0292662 A1* 10/2015 Majocka ..... E03F 5/041 29/527.1
2016/0122995 A1* 5/2016 Corder ..... B01D 35/02 206/321
2016/0244955 A1* 8/2016 Allred, III ..... E03C 1/26
2016/0298324 A1* 10/2016 Blamble ..... E03F 3/046
2017/0130442 A1* 5/2017 Brooks ..... E03F 5/0407
2018/0100298 A1* 4/2018 Willburn ..... E03C 1/26
2018/0171618 A1* 6/2018 Erlebach ..... E03C 1/20
2019/0119896 A1* 4/2019 Priester ..... E03F 5/0407
2019/0242107 A1* 8/2019 McLeod ..... E03F 5/06
2019/0316334 A1* 10/2019 Larson ..... E03F 5/0408
2020/0040558 A1* 2/2020 Ewers ..... E03C 1/292
2020/0217059 A1* 7/2020 Blamble ..... E03F 5/0409
2020/0291631 A1* 9/2020 Boeltl ..... E03F 5/06
2021/0071404 A1* 3/2021 Boeltl ..... A47K 3/40
2021/0180307 A1* 6/2021 Whiteside ..... E03F 5/041
2021/0254321 A1* 8/2021 Ritger ..... E03C 1/22
2021/0285196 A1* 9/2021 Glazar ..... E03C 1/262
2023/0035222 A1* 2/2023 Blamble ..... E03F 3/046
2023/0081504 A1* 3/2023 Ciepluch ..... E03F 5/041 210/163
2023/0250624 A1* 8/2023 Lorkowski ..... E03F 5/0409
2023/0279654 A1* 9/2023 Say ..... E03F 5/0407 210/163
2023/0313518 A1* 10/2023 Zhang ..... E03F 5/0407 52/198
2023/0366193 A1* 11/2023 Meyers ..... E03F 5/0409
2024/0044122 A1* 2/2024 Say ..... E03F 5/0407
2025/0034855 A1* 1/2025 Blamble ..... E03F 5/0408
2025/0146267 A1* 5/2025 Ciepluch ..... E03F 5/06
2025/0171995 A1* 5/2025 Ritger ..... E03F 5/0407
2025/0347100 A1* 11/2025 Say ..... E04G 15/061
2026/0110167 A1* 4/2026 Barker ..... E03F 5/0408

* cited by examiner

LIGATURE MITIGATION DRAIN

CROSS REFERENCE TO RELATED APPLICATIONS

U.S. Provisional application No. 63/244,286, filed on Sep. 15, 2021.

U.S. Non-Provisional application Ser. No. 17/896,050, filed on Aug. 25, 2022

BACKGROUND OF THE INVENTION

1. Field of the Invention

Embodiments of the present disclosure relate generally to ligature mitigation drains.

2. Background

Drains are commonly installed in the floors of rooms of buildings which utilize liquids, such as bathrooms, kitchens, and showers, in order remove water from the floor surface and to avoid damage and injury to persons utilizing these rooms. In certain buildings, such as prisons, mental health facilities, and medical institutions, individuals may attempt to utilize these drains as an anchor point, or tie-off, to connect a string, cord, wire, etc. (a ligature device) in an attempt to commit self-harm, a known issue which unfortunately often results in the loss of numerous human lives every year. Drains can be weaponized in this way when the ligature device is drawn through a first opening in the drain, around secure portions of the drain, and then back through a second opening in the drain (openings which would normally allow fluid to enter the drain). As such, a drain which mitigates the ability of an individual to attach a ligature device and can be retrofitted into existing drain bodies or installed in new installations is desirable.

SUMMARY OF THE INVENTION

The invention relates, in one embodiment, to an ligature mitigation drain which comprises an outer ring, an inner ring, a termination ring, and a washer covering the bottom of the inner ring and the termination ring. The outer ring surrounds the inner ring, and the inner ring surrounds the termination ring and the outer ring further comprises at least two extensions extending toward and touching the inside ring and the inner ring further comprises at least two extensions extending toward and touching the termination ring. A space between the outer ring and the inner ring defines an outer opening surrounding the inner ring through which fluid can enter the drain and exit through the bottom thereof, while a space between the inner ring and the termination ring defines an inner opening surrounding the termination ring, which is also configured to allow fluid to enter the drain and exit through the bottom thereof. The top surface of the outer ring, inner ring, and termination ring are flush with one another. In one aspect of the invention, the outer opening and the inner opening are different distances.

The invention relates, in another embodiment, to an ligature mitigation drain which comprises an outer ring, an inner ring, a termination ring, and a castle nut configured to secure to a drain body. The termination ring is located inside the inner ring, the inner ring is located inside the outer ring, and the top surface of the termination ring of the inner, outer, and termination rings flush with one another. The outer ring attaches to the castle nut. The castle nut may further comprise threading configured to thread into a drain body, thereby allowing the drain to be retrofit to an existing drain body.

DETAILED DESCRIPTION OF THE INVENTION

Figure 1:
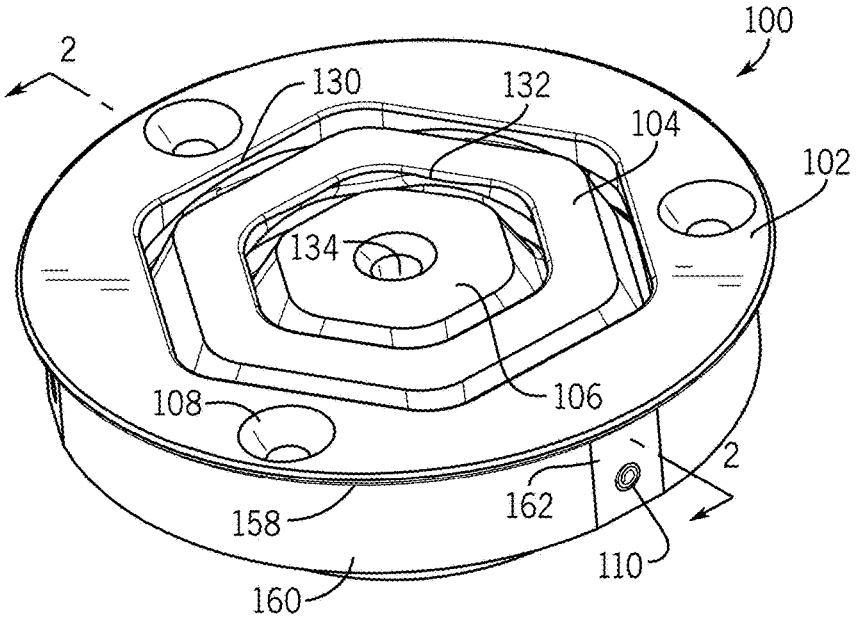
FIG. 1 is a top perspective view of an embodiment of the present invention.

For the following defined terms, these definitions shall be applied, unless a different definition is given in the claims or elsewhere in this specification. All numeric values are herein assumed to be modified by the term "about," whether or not explicitly indicated. The term "about," in the context of numeric values, generally refers to a range of numbers that one of skill in the art would consider equivalent to the recited value (e.g., having the same function or result). In many instances, the term "about" may include numbers that are rounded to the nearest significant figure. Other uses of the term "about" (e.g., in a context other than numeric values) may be assumed to have their ordinary and customary definition(s), as understood from and consistent with the context of the specification, unless otherwise specified.

Although some suitable dimensions, ranges, and/or values pertaining to various components, features and/or specifications are disclosed, one of skill in the art, incited by the present disclosure, would understand desired dimensions, ranges, and/or values may deviate from those expressly disclosed.

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise. It is to be noted that in order to facilitate understanding, certain features of the disclosure may be described in the singular, even though those features may be plural or recurring within the disclosed embodiment(s). Each instance of the features may include and/or be encompassed by the singular disclosure(s), unless expressly stated to the contrary.

A ligature mitigation drain will now be described with references in FIGS. 1-14. Turning to the drawings, where the reference characters indicate corresponding elements throughout the several figures, attention is first directed to FIG. 1 where a top perspective view of an embodiment of the present invention is shown, illustrating its composition and the apparatus is generally indicated by reference character 100. Ligature mitigation drain 100 comprises an outer ring 102, inner ring 104 and termination ring 106. Termination ring 106 is located inside of inner ring 104 and inner ring 104 is located inside of outer ring 102, and configured so the top surface of each ring is flush with one another. Further, outer ring 102 and inner ring 104 are configured to create at an outer opening or gap 130 around inner ring 104, which allows water or other such liquid to travel into said outer opening 130, through drain 100, and out the bottom of drain 100 into a drainpipe. Further, inner ring 104 and termination ring 106 are configured to create an inner opening or gap 132 around termination ring 106, which provides additional drainage capability of drain 100. Individually, outer opening 130 and inner opening 132 each allow liquid flow at rate of at least 2.5 gallons-per-minute (gpm), or 5 gpm combined, in order to meet building code requirements in many states, even if one of the openings is clogged with debris. If desired, termination ring 106 may further comprise termination opening 134 formed therethrough (and centrally located in the current embodiment) to provide additional drainage. In part, termination ring 106 is secured to inner ring 104 by an interference or transition fit and inner ring 104 is secured to outer ring 102 by an interference or transition fit, that is, all three rings are press fit together (see also FIG. 8).

Figure 2:
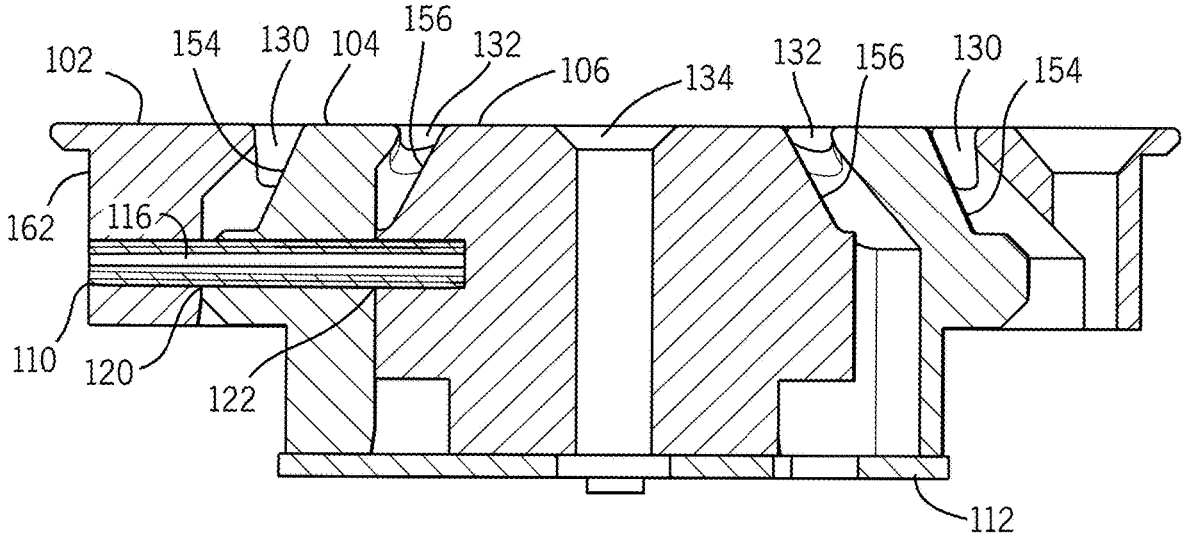
FIG. 2 is a section view of an embodiment of the present invention taken along line 2-2 of FIG. 1.

Turning to FIG. 2, a cross section of an embodiment of the present invention along line 2-2 of FIG. 1 is shown. Outer ring 102 further comprises at least one first post opening 110 formed therethrough the side of outer ring 102 of which a post 116 is secured through by an interference or transition fit. Inner ring 104 further comprises at least one second post opening 120 formed therethrough. Termination ring 106 also further comprises at least one third post opening 122 formed therein and located in-line with a second post opening 120 of inner ring 104 and also in-line with a first post opening 110 of outer ring 102, enabling post 116 to extend through first post opening 110, second post opening 120, and third post opening 122, thereby further securing outer ring 102, inner ring 104 and termination ring 106 together and maintaining the top surface of each ring remains in-line with one another. In the current embodiment there are 3 first post openings 110, 3 second post openings 120, and 3 third post openings 122. Each first post opening 110 in outer ring 102 is in the side of the ring (first cylindrical base 160 described below), located along the perimeter thereof and each is located equidistant from at least one other first post opening 110. Likewise, each second post opening 120 on inner ring 104 is in the side of the ring (second cylindrical base 164 described below), located along the perimeter of the ring and located equidistant from at least one other second post opening 120. In addition, each third post opening 122 on termination ring 106 is on the side of the ring (second ridge 180 described below), located along the perimeter of the ring and positioned equidistant from at least one other third post opening 122.

Outer ring 102 further comprises at least one extension 124, preferably 3, each located in-line with a first post opening 110 (first post opening 110 is formed through extension 124, see FIGS. 3-4), wherein each extension 124 extends from the inner perimeter of outer ring 102 toward inner ring 104, ultimately touching the exterior of inner ring 104, ideally creating an interference or transition fit with inner ring 104. Each extension 124 along with the interior perimeter of outer ring 106 and exterior perimeter of inner ring 104 create each outer opening 130, thereby allowing liquid drainage through outer opening 130. Likewise, Inner ring 104 further comprises at least one extension 126 (see FIG. 5) located in-line with second post opening 120 (second post opening 120 is formed through extension 126) and extends from the inner perimeter of inner ring 104 toward termination ring 106, ultimately touching termination ring 106, ideally creating an interference or transition fit. Each extension 126 along with the interior perimeter of inner ring 104 and exterior perimeter of termination ring 106 define inner opening 132, thereby allowing additional liquid drainage. As mentioned earlier, drain 100 is secured together by post 116. Post 116 extends through a first post opening 110 in outer ring 102, through outer ring 102, extension 124, second post opening 120, inner ring 104, extension 126, into third post opening 122 (and thus into termination ring 106). Post can be secured by known methods including interference fit, interference fit, or adhesive. Post 116 could also be a screw with the first post opening 110, second post opening 120, and third post opening 122 it extends through being threaded to operate with said screw threads. Outer ring 102, inner ring 104, and termination ring 106 may be made of any rigid or semi-rigid materials like plastic or metal, such as aluminum, copper, or stainless steel (or a composition of multiple materials).

Turning back to FIG. 1, outer ring 102 further comprises at least one countersunk first aperture 108 formed therethrough the top surface of outer ring 102. In the preferred embodiment three countersunk first apertures 108 are formed in outer ring 102 which allow a screw (shown in FIG. 9 as element 118) to secure drain 100 to a drain body 210 via castle nut 200 (see FIG. 10). In the preferred embodiment there are 3 countersunk first apertures 108 configured in a triangular pattern through the top surface of outer ring 102 and each located between an extension 124 (3 in the current embodiment). Outer ring 102 further comprises a first cylindrical base 160 which further comprises at least one flat section 162 located along the outer perimeter of first cylindrical base 160 where each first post opening 110 is formed. Outer ring 102 further comprises lip 158 surrounding the top face and extending perpendicular to and away from first cylindrical base 160 and configured to allow the top face of outer ring 102 to lie flush with the top face of the surface surrounding drain body 210.

Figure 3:
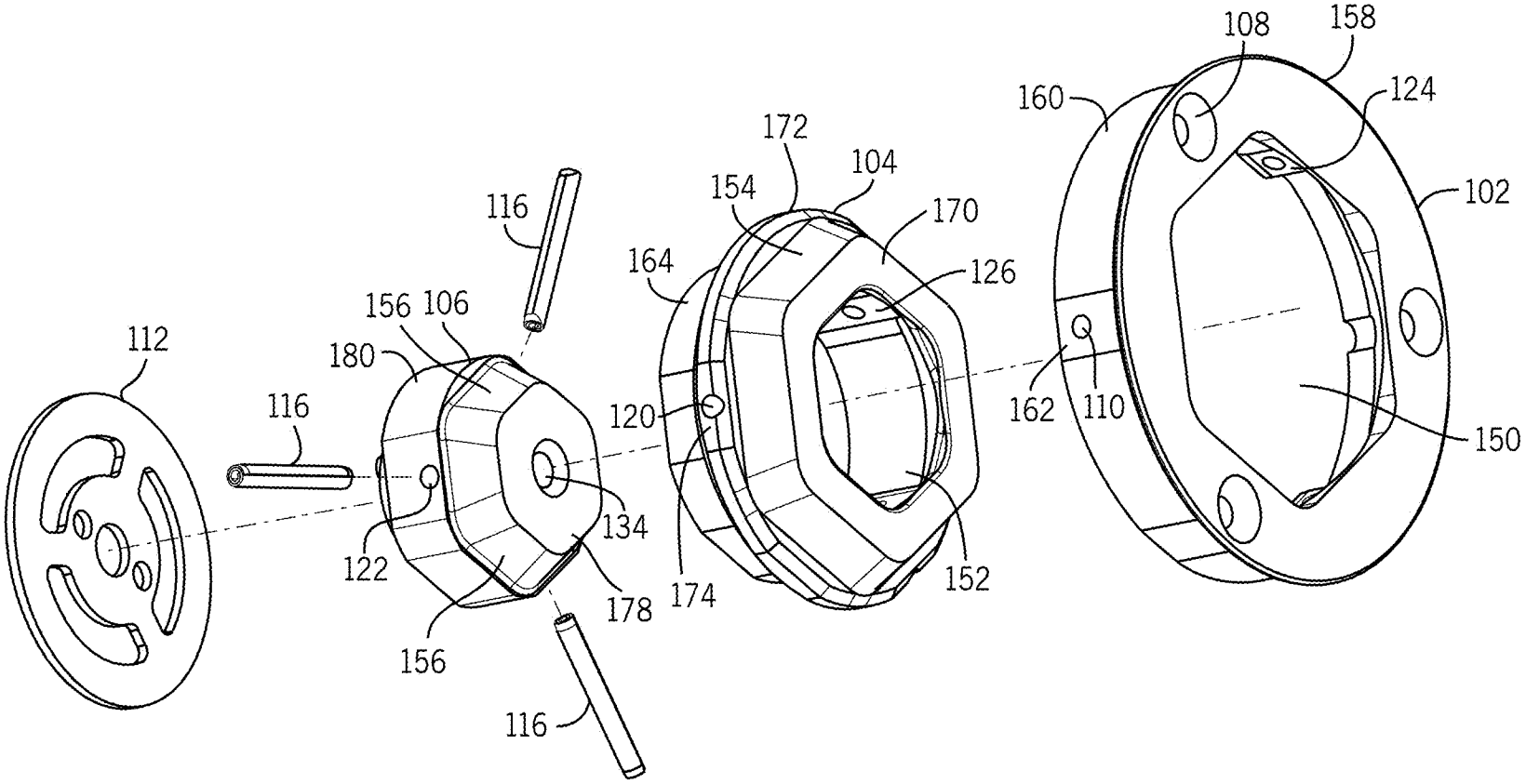
FIG. 3 is an exploded view of an embodiment of the present invention.
Figure 4:
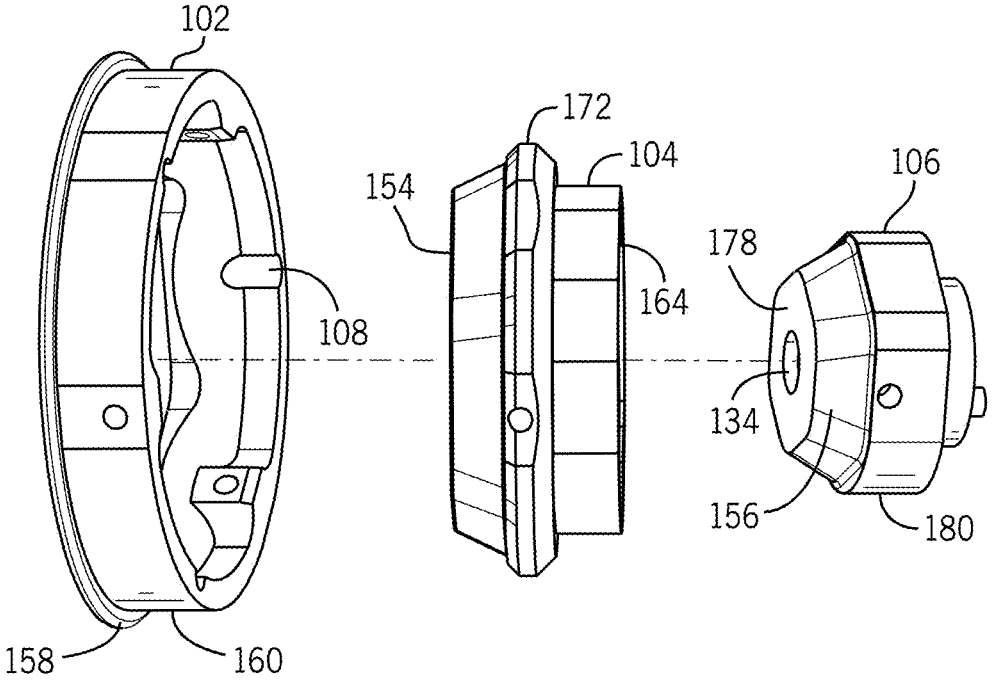
FIG. 4 is a side view of outer ring 102, inner ring 104 and termination ring 106.

Turning to FIGS. 3 and 4, an exploded view and a side view of an embodiment of outer ring 102, inner ring 104 and termination ring 106 is shown. Outer ring 102 further comprises second aperture 150 formed therethrough and centrally located in outer ring 102. Inner ring 104 further comprises third aperture 152 formed therethrough, wherein third aperture 152 is centrally located in inner ring 104. In the present embodiment second aperture 150 of outer ring 102 and third aperture 152 of inner ring 104 and termination ring 106 are all hexagon shaped of different sizes but they may all comprise other shapes desired including but not limited to circular, square, rectangular and octagonal.

Figure 5:
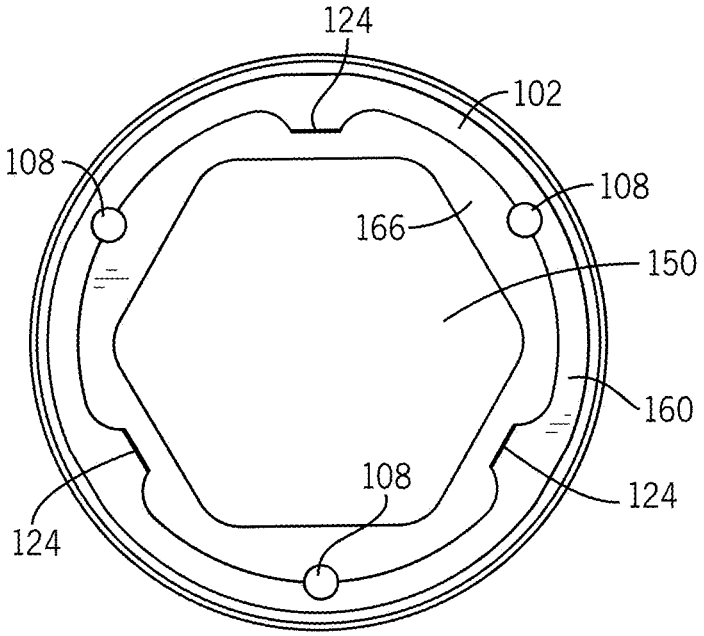
FIG. 5 is a bottom view of an embodiment of outer ring 102.

Turning to FIG. 5, a bottom view of an embodiment of outer ring 102 is shown, wherein outer ring 102 further comprises a profile 166 extending from the inside wall of first cylindrical base 160 and extending to second aperture 150. Profile 166 may be angular or curvilinear and at least partially surrounds each extension 124 and each countersunk first aperture 108. Each extension 124 extends from the bottom of the inside wall of first cylindrical base 160 to the top of profile 166, where it blends into profile 166. Turning back to FIG. 3, inner ring 104 further comprises a top face 170 surrounding third aperture 152 and connected to a first tapered portion 154 surrounding the perimeter of top face 170 and extending downward at an angle to a first ridge 172. First tapered portion 154 extends preferably at a 60 degree angle in respect to top face 170, but any angle between 0 and 90 could be utilized if desired. First ridge 172 is ideally circular and extends around first tapered portion 154, and extends perpendicular to and away from inner ring 104. First ridge 172 further comprises at least one flat surface 174 where each second post opening 120 is located. Each flat surface 174 touches a corresponding extension 124 of outer ring 102 to create an interference or transition fit of inner ring 104 with outer ring 102. Inner ring 104 further comprises a second cylindrical base 164 which extends from, and perpendicular to, first ridge 172 perpendicular. Second cylindrical base 164 is a smaller diameter than first tapered portion 154.

Figure 6:
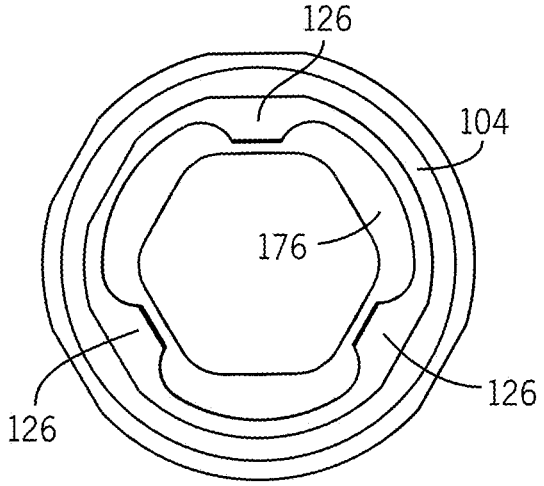
FIG. 6 is a bottom view of an embodiment of inner ring 104.

Turning to FIG. 6, a bottom view of an embodiment of inner ring 104 is shown (at least one first post opening 110 is not shown). Inner ring 104 further comprises a profile 176 extending from the inside wall of first ridge 172 and extending to third aperture 152. Profile 176 may be angular or curvilinear and partially surrounds each extension 126. Each extension 126 extends from the bottom of the inside wall of second cylindrical base 164 to the top of profile 176, where it blends into profile 176.

Turning back to FIGS. 3-4, termination ring 106 further comprises a top face 178 surrounding termination opening 134 and is connected to a second tapered portion 156 surrounding the perimeter top face 178 and extending downward at an angle to a second ridge 180. Second tapered portion 156 extends preferably at a 60 degree angle in respect to top face 178, but any angle between 0 and 90 could be utilized if desired. Second ridge 180 is ideally hexagon shaped (or a matching shape to that of third aperture 152 is) with rounded corners and extends around second tapered portion 156. Second ridge 180 further comprises at least one flat surface 182 where each third post opening 122 is located. Each flat surface 182 touches a corresponding extension 126 of inner ring 104 to create an interference or transition fit of termination ring 106 with inner ring 104. The angles of first ridge 172 and second ridge 180 further prevent a person from looking into the drain to determine whether they can create an anchor point, making it more difficult to utilize drain 100 for potential self-harm.

Figure 7:
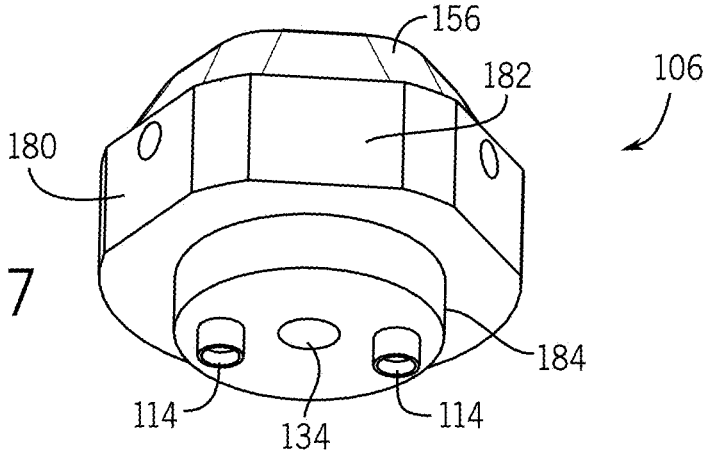
FIG. 7 is a bottom perspective view of an embodiment of termination ring 106.

Turning to FIG. 7, a bottom perspective view of an embodiment of termination ring 106 is shown (at least one third post opening 122 is not shown). Termination ring 106 further comprises a cylindrical base 184 which extends from second ridge 180 perpendicular to and away from top face 178 and is smaller in diameter than second ridge 180. Cylindrical base 184 further comprises at least one rivet 114 extending from the bottom thereof and configured to secure a washer 112 (see FIG. 3) to drain 100. Termination ring 106 is taller than outer ring 102 and about the same height as inner ring 104.

Figure 8:
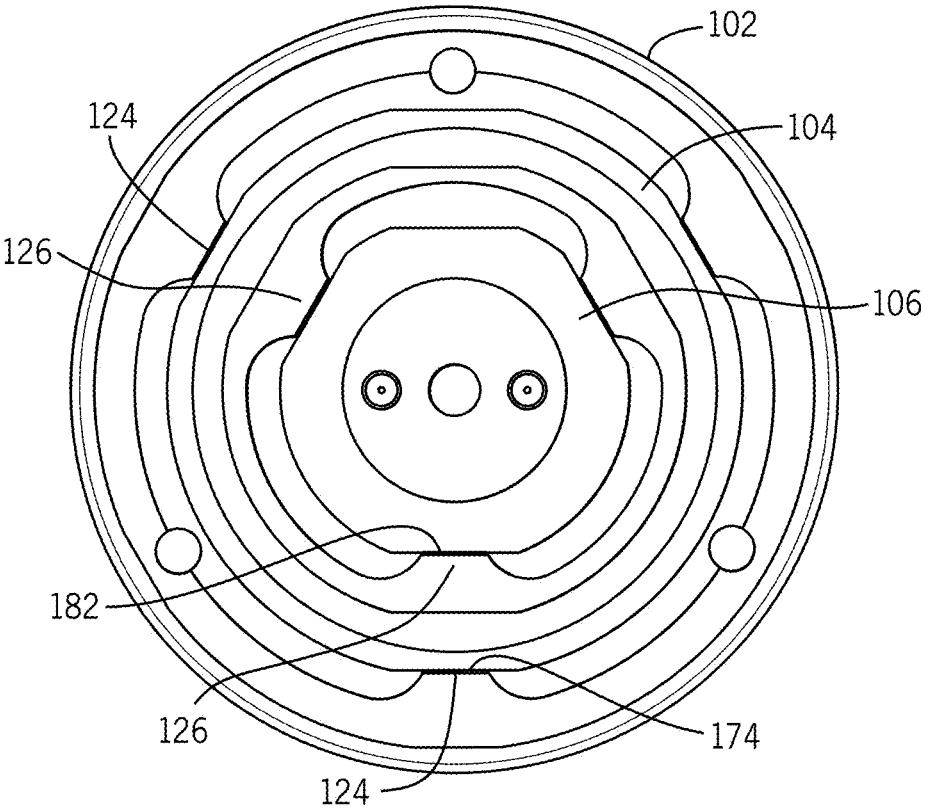
FIG. 8 is a bottom view of an embodiment of outer ring 102, inner ring 104, and termination ring 106 stacked on top of each other before being press fit together.

As mentioned earlier, inner ring 104 is configured to secure inside outer ring 102 wherein second aperture 150 of outer ring 102 and first tapered portion 154 of inner ring 104 define and create outer opening 130. Further, termination ring 106 is configured to secure inside inner ring 104 wherein second tapered portion 156 of termination ring 106 and third aperture 152 of inner ring 104 define and create inner opening 132. Turning to FIG. 8, a bottom view of an embodiment of outer ring 102, inner ring 104, and termination ring 106 stacked on top of each other before being press fit together is shown, illustrating how each ring fits together.

Figure 9:
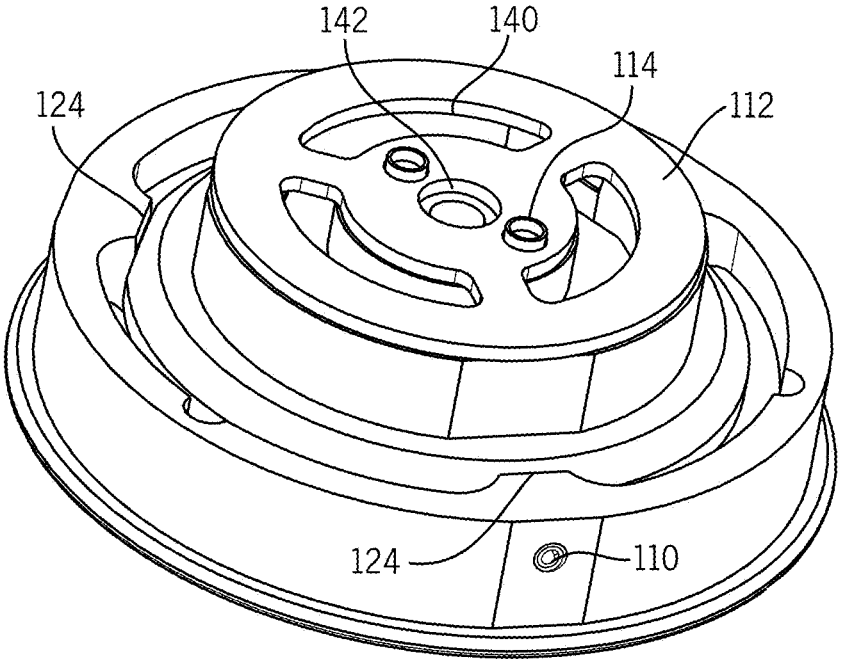
FIG. 9 is a bottom perspective view of an embodiment of the present invention.

Turning to FIG. 9, a bottom perspective view of an embodiment of the present invention is shown. Drain 100 further comprises a washer 112 and at least one rivet 114, wherein rivet 114 secures washer 112 to termination ring 106 and puts washer 112 in communication with base 164 of inner ring 104. Washer 112 makes it more difficult for a person to pick drain 100 or wedge material around inner ring 104 or termination ring 106 of drain 100 (via outer opening 130, inner opening 132, or termination opening 134) to create an anchor point for self-harm. Washer 112 is circular in shape with a diameter at least equal to that of the bottom diameter of inner ring 104 and comprises at least one fourth aperture 140 formed therethrough, preferably 3. Each fourth aperture 140 is curvilinear in shape and configured to order to allow liquid to flow through washer 112 via inner opening 132. In addition, washer 112 may further comprise a central aperture 142 formed therethrough and centrally located in washer 112 may also be present in order to allow additional liquid drainage via termination opening 134. Further, each fourth aperture 140 is located equidistant between the outer edge of washer 112 and the outer edge of central aperture 142 and arranged around central aperture 142 but could be located in any desired location. In the preferred embodiment two rivets 114 are used to secure washer 112 to termination ring 106 and are located in-line with one another and on either side of central aperture 142.

Drain 100 prevents ligature device attachment in multiple ways, the first is through outer opening 130. Initially, first tapered portion 154 of inner ring 104 guides a ligature device fed into the top of outer opening 130 away from inner opening 132 or termination opening 134, first tapered portion 154 obscures a user's view when looking down into drain 100, and inner ring 104 is taller (or thicker) than inner ring 102, thus making it more difficult for a user to feed the ligature device back through inner opening 132, termination opening 134, or an opposing section of outer opening 130 in an attempt to utilize inner ring 104 or termination ring 106 as an anchor point. In addition, feeding a ligature device through inner opening 132 is also thwarted for a few reasons. First, washer 112 blocks and obfuscates a ligature device from threading down or up through washer 112 out of or into inner opening 132. Second, second tapered portion 156 guides a ligature device away from termination opening 134 and into the bottom of washer 112 (a dead end), thereby effectively stopping the ligature device from any traveling further and pooling or curling around washer 112. Third, second tapered portion 156 acts as a visual block to a user trying to understand where outer inner opening 132 may lead. Effectively, outer opening 130 extends a first distance, inner opening 132 extends a second distance, and termination opening 134 extends a third distance, where which each distance is a different amount, greatly reducing or eliminating the ability of a user to use drain 100 as an anchor point for a ligature device as ligature devices like a rope/etc. will not hold its shape enough to snake through openings of different heights easily.

Figure 10:
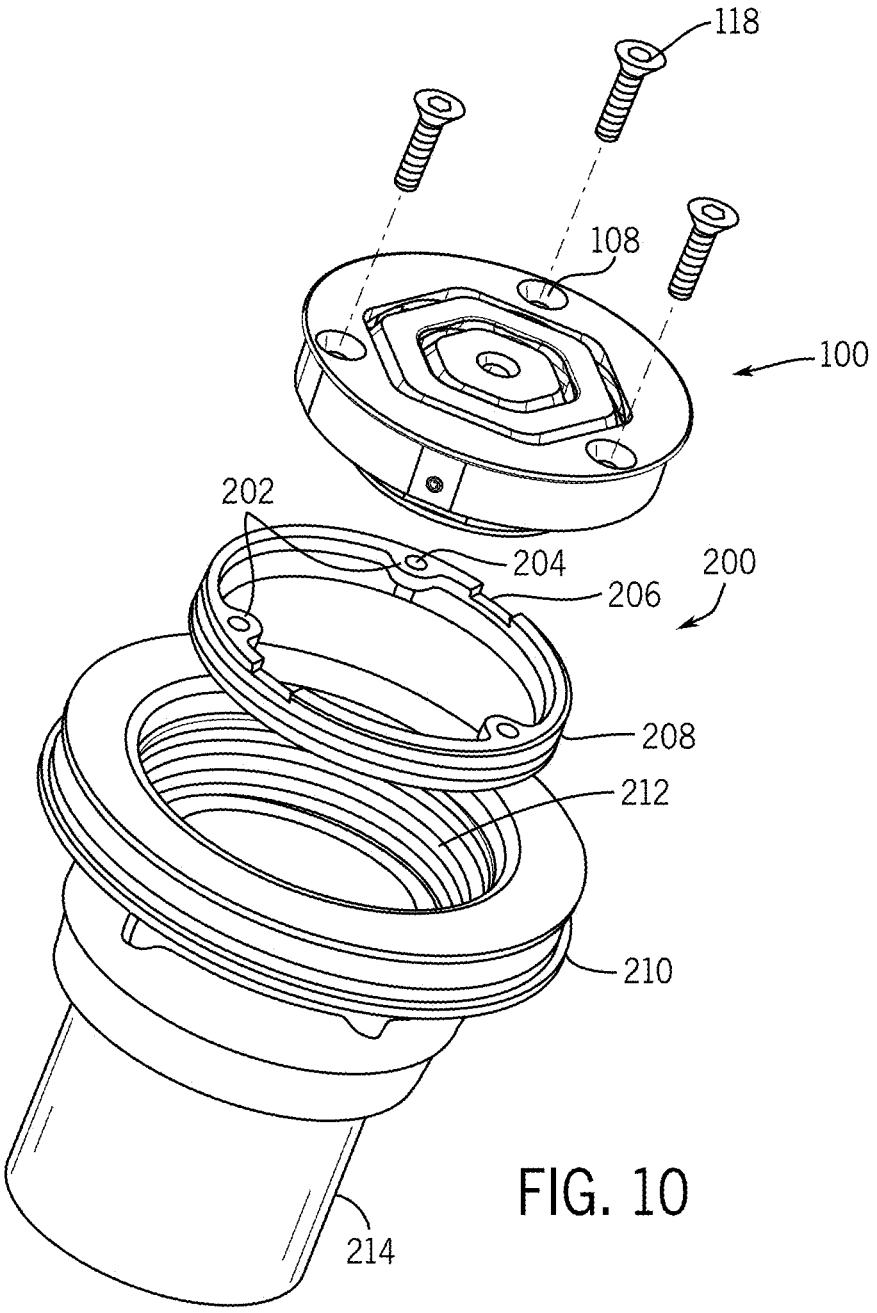
FIG. 10 is an exploded view of an embodiment of the present invention.

Turning to FIG. 10, an exploded view of an embodiment of the present invention is shown. Drain 100 may further comprise a castle nut 200 which is cylindrical in shape and includes threading 208 configured to allow castle nut 200 to screw into the interior threads 212 of a drain body 210, which may already be installed in a surface and connected to a drainpipe 214. Castle nut 200 is configured to operate with common sizes of drainpipe, such as 2 inch diameter, however any size could be made as desired to operate with a specific drain. Castle nut 200 further comprises at least two notches 206 formed along the top edge of nut 200, and configured to receive a castle nut wrench (see FIG. 11), which allows castle nut 200 to be screwed into a drain body 210. It is preferable that castle nut 200 is screwed into drain body 210 to a depth that allows the top surface of drain 100 to lie flush with the top surface of drain body 210, creating a watertight seal with drain body 210. Castle nut 200 can be configured to screw into virtually any drain body, such as for example an Oatey® 140 Series or Ferguson® PF-140NC branded body. Castle nut 200 further comprises at least one flange 202 with a threaded opening 204 formed therethrough and configured to align with a countersunk first aperture 108 of outer ring 102, thereby allowing outer ring 102, inner ring 104 and termination ring 106 to attach to castle nut 200. Once castle nut 200 is secured in drain body 210, then outer ring 102, inner ring 104 and termination ring 106 (already assembled together) can be secured to castle nut 200 (and thus secured to drain body 210) by lining up each countersunk first aperture 108 with a threaded opening 204 and fastening a screw 118 through each first aperture 108 and opening 204 combination. It is preferable to utilize tamper resistant screws, such as security or star shaped screws. Once each screw 118 is tightened, the threads 208 of castle nut and the threads 212 of drain body opening 204 are further forced to touch thereby creating a tighter seal and requiring a greater amount of torque to unscrew drain 100 (in addition to a special shaped screwdriver), making it more difficult to tamper with drain 100 for ligature device attachment.

Figure 11:
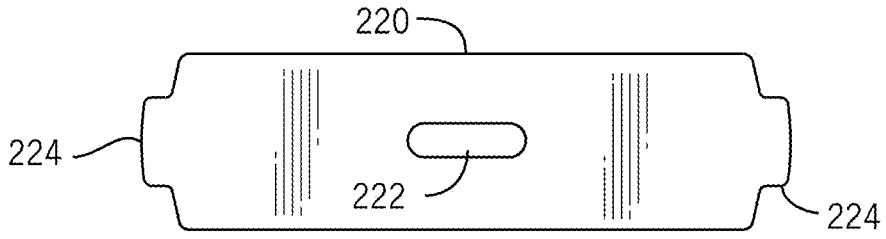
FIG. 11 is a front view of an embodiment of castle nut wrench 220.

Turning to FIG. 11, a front view of an embodiment of castle nut wrench 220 is shown. Castle nut wrench 220 comprises a rectangular body with a protrusion 224 extending from each end, wherein each protrusion is configured to connect with a notch 206 of castle nut 200. Wrench 220 allows a person to rotate castle nut 200 to secure it into a drain body 210 with internal threading 212. Further, wrench 220 may further comprise orifice 222 formed therethrough and configured to receive a flathead screwdriver, or similar, to more easily allow a person to install or un-install castle nut 200 from drain body 210.

Figure 12:
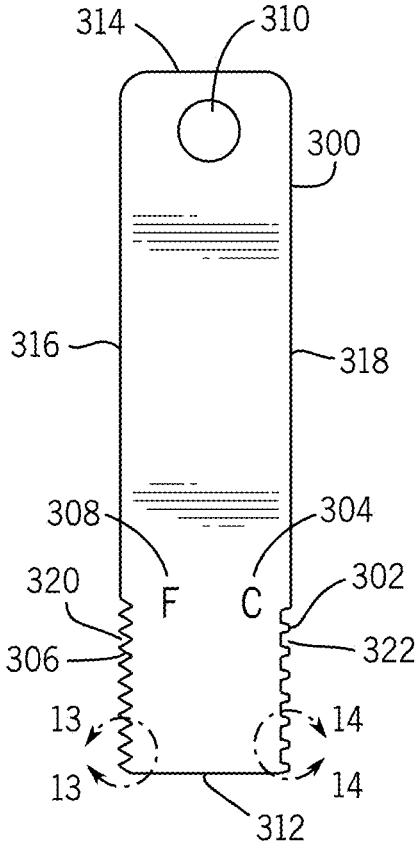
FIG. 12 is a front view an embodiment of thread key 300.
Figure 13:
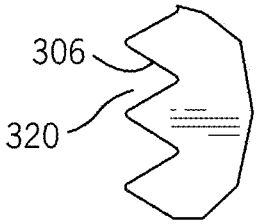
FIG. 13 is an enlarged detail indicated by line 13-13 of FIG. 12.
Figure 14:
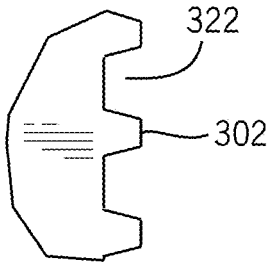
FIG. 14 is an enlarged detail indicated by line 14-14 of FIG. 12.

Turning to FIG. 12, a front view of an embodiment of thread key 300 is shown. Thread key 300 is used to determine the thread type, fine thread or coarse thread, of threads 212 of a drain body 210 that is already installed to a drainpipe 214. Once the thread type of a drain body 210 is known, castle nut 200 can be configured with the matching/compatible fine or coarse thread type of drain body drain body 210 threading 212 so castle nut 200 (and thus drain 100) can be retrofitted into an existing drain body 210. Thread key 300 is generally rectangular in shape and comprises a first end 312, a second end 314, a first side 316 and a second side 318. First side 316 further comprises at least one first tooth 306 and at least one fine space 320 located on at least one side of each first tooth 306 wherein each first tooth 306 is configured to fit in-between the threads 208 of a drain body 210 when threads 208 are fine. The at least one first tooth 306 is triangular shaped and may be cut into first side 316. Turning to FIG. 13, an enlarged detail indicated by line 13-13 of FIG. 12 is shown. Each fine space 320 from one side of first tooth 306 to the adjoining side of a second first tooth 306 which defines space 320 is about 60 degrees. In the current embodiment there are ten (10) first teeth 306 located adjacent to first end 312 located in-line along first side 316, but any number of first teeth and fine spaces may be utilized. Thread key 300 also comprises a symbol 308 located on at least one face of thread key 300 which indicate that at least one first tooth 306 and at least one fine space 320 are configured to align with a fine thread. In the current embodiment symbol 308 is the letter "F". Second side 318 further comprises at least one second tooth 302 and at least one coarse space 322 located on at least one side of each second tooth 302 wherein second tooth 302 is configured to fit in-between the threads 208 of a drain body 210 when threads 208 are coarse. At least one second tooth 306 is trapezoidal shaped and may be cut into second side 318. Turning to FIG. 14, is an enlarged detail indicated by line 14-14 of FIG. 12 is shown. Each coarse space 322 from one angled side of second tooth 302 to the adjoining side of a neighboring second tooth 302 which defines space 322 is about 29 degrees. In the current embodiment there are seven (7) second teeth 302 located adjacent to first end 312 located in-line along second side 318, but any number of first teeth and fine spaces may be utilized. Thread key 300 also comprises a symbol 304 located on at least one face of thread key 300 which indicate that at least one second tooth 302 and at least one fine space 322 are configured to align with a coarse thread. In the current embodiment symbol 304 is the letter "C". Thread key 300 may further comprise a passage 310 formed therethrough and centrally located near second end 314, configured to allow secure thread key 300 to a structure, such as a keyring. Thread key 300, wrench 220, post 116, castle nut 200, and washer 112 may be made of any rigid or semi-rigid materials like plastic or metal, such as aluminum, copper, or stainless steel. Likewise, post 116, castle nut 200, and washer 112 may also be made of an A method for installing a drain comprises the steps of: determining the thread type of a drain body, screwing a castle nut with a matching thread type into the drain body, placing a drain on top of the drain body, extending a fastener through the at least one opening in the outer ring of the drain and the at least one opening in the castle nut, and tightening the fastener to secure the drain and castle nut together so the top surface of the drain and the top surface of the drain body are flush. In addition, the step of determining the thread type of a drain body may further comprise using a thread key to determine if a drain body is a coarse or fine thread type.

While the present invention has been described above in terms of specific embodiments, it is to be understood that the invention is not limited to these disclosed embodiments. Many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

What is claimed is:

1. A method for installing a drain in a drain body comprising the steps of:

screwing a castle nut (200) having peripheral male threads (208) into a drain body (210) having threadably matching female threads (212);

inserting a drain (100) into an interior of the castle nut (200), the drain (100) including an outer ring (102), an inner ring (104) within the outer ring (102), and a termination ring (106) within the inner ring (104), a top surface of each ring being flush with one another, with spaces between each ring defining drainage paths;

fastening a screw (118) through the outer ring (102) and into a threaded opening (204) in the castle nut (200); and tightening the screw (118) to secure the drain (100) and castle nut (200) together so a top surface of the drain (100) is flush with a top surface of the drain body (210).

2. The method for installing a drain according to claim 1, further comprising a step of determining the female thread type of the drain body (210).

3. The method for installing a drain according to claim 2 wherein the step of determining the female thread type of the drain body is determined with a thread key.

* * * * *